US005195548A

United States Patent [19]

Roger

[11] Patent Number: 5,195,548

[45] Date of Patent: Mar. 23, 1993

[54] WASHING DEVICE

[75] Inventor: Tanguy Roger, Villeneuve d'Ascq, France

[73] Assignee: FCB, Montreuil, France

[21] Appl. No.: 712,339

[22] Filed: Jun. 7, 1991

[30] Foreign Application Priority Data

Jun. 11, 1990 [FR] France ..... 90 07216

[51] Int. Cl.[5] ..... B08B 3/02

[52] U.S. Cl. ..... 134/167 R; 134/172; 134/198; 239/265

[58] Field of Search ..... 134/167 R, 166 R, 172, 134/198; 403/76, 78; 237/264, 265; 285/263, 261

[56] References Cited

U.S. PATENT DOCUMENTS

| | | | |
|---|---|---|---|
| 2,569,588 | 10/1951 | Terry et al. | 134/167 R X |
| 3,169,707 | 2/1965 | Williams | 134/167 R X |
| 3,645,452 | 2/1972 | Stoeckel et al. | 239/265 X |
| 3,741,808 | 6/1973 | Stalker | 134/167 R X |
| 4,163,455 | 8/1979 | Hebert et al. | 134/167 R |
| 4,338,038 | 7/1982 | Cloarec | 403/76 |
| 4,520,514 | 6/1985 | Johnson | 134/107 R X |
| 4,716,917 | 1/1988 | Schmidt | 134/107 R |

FOREIGN PATENT DOCUMENTS

| | | | |
|---|---|---|---|
| 885315 | 5/1943 | France | 134/167 R |
| 330683 | 10/1935 | Italy | 134/167 R |
| 1366121 | 1/1988 | U.S.S.R. | 239/264 |

*Primary Examiner*—Frankie L. Stinson
*Attorney, Agent, or Firm*—Collard & Roe

[57] ABSTRACT

The invention relates to a washing device for an apparatus comprising a tank having a wall defining an interior chamber for holding a liquid and partitions dividing the interior chamber, the partitions having parts which are not immersed in the liquid and are susceptible to becoming fouled. The washing device includes tubes passing through the wall of the tank and each of the tubes having an end extending into the interior chamber, tubing in communication with the tubes for feeding a washing liquid thereto, a nozzle affixed to each tube end and arranged to project the washing liquid onto respective ones of the partition parts susceptible to becoming fouled, a body of revolution carrying each tube, a bearing box for each body, the bearing box being mounted on the wall of the tank and the body being pivotal in the bearing box, the bearing box having a bottom defining an opening receiving the tube and being of a dimension which permits angular movements of the tube upon pivoting of the body, and a cover closing the bearing box outside the tank. A lever is affixed to the body and passes through an opening in the bearing box cover, the opening being of a dimension which permits angular movements of the lever for pivoting the body and the tube carried thereby.

2 Claims, 2 Drawing Sheets

WASHING DEVICE

BACKGROUND OF THE INVENTION

1. Field of the Invention

The present invention relates to a washing device for an apparatus comprising a tank having a wall defining an interior chamber for holding a liquid and partitions dividing the interior chamber, the partitions having parts which are not immersed in the liquid and are susceptible to becoming fouled, the washing device comprising tubes passing through the wall of the tank and each of the tubes having an end extending into the interior chamber, tubing in communication with the tubes for feeding a washing liquid thereto, and a nozzle affixed to each tube end and arranged to project the washing liquid onto respective ones of the partition parts susceptible to becoming fouled.

2. Description of the Prior Art

Apparatus of this type is used particularly for the continuous crystallization of sugar, and to avoid fouling of the non-immersed parts of the partitions in the crystallization tank, it has been necessary to scour the non-immersed partition parts periodically with a washing liquid, which may be water or an undersaturated solution of the product to be crystallized. More particularly, to clean the vertical partitions dividing the interior chamber of the tank into a series of compartments or cells, nozzles projecting flat jets of washing liquid have been so disposed above the partitions that the median plane of the jets coincides with the plane of the partitions and the nozzles cyclically project atomized washing liquid against the partitions at a very low flow rate. The nozzles are affixed to the interior ends of tubes which pass through the tank wall and are connected to tubing which feeds the washing liquid to the nozzles. It is necessary for the nozzles to be properly oriented relative to the partitions for the cleaning operation to function properly. Therefore, a dry test is necessary before each nozzle is fixed in place because the edge of the partitions is not perfectly rectilinear. During operation, some of the partitions are deformed under the thermal and/or mechanical stresses occurring in the crystallization process and, in this case, the jets of washing liquid are not directed properly against the fouled partition parts and the nozzles fail to wash them effectively.

While nozzles which can be oriented are known, they cannot be oriented from the outside after they have been placed in the closed tank.

SUMMARY OF THE INVENTION

It is the primary object of this invention to permit the ready adjustment of the position of the washing nozzles in the tank during the continuing operation of the apparatus, and the dismounting of the nozzles for cleaning without entering the interior tank chamber.

In an apparatus of the first-described type, the invention accomplishes this and other objects by providing a body of revolution carrying each tube and a bearing box for each body, the bearing box being mounted on the wall of the tank and the body being pivotal in the bearing box. The bearing box has a bottom defining an opening receiving the tube and being of a dimension which permits angular movements of the tube upon pivoting of the body, and cover closing the bearing box outside the tank. A lever is affixed to the body and passes through an opening in the bearing box cover, the opening being of a dimension which permits angular movements of the lever for pivoting the body and the tube carried thereby.

The body of revolution carrying the tube may be cylindrical or spherical.

BRIEF DESCRIPTION OF THE DRAWING

The above objects, advantages and features of the invention will become more apparent from the following detailed description of two now preferred embodiments thereof, taken in conjunction with the accompanying drawing wherein FIG. 1 schematically illustrates a longitudinal section of a continuous sugar crystallization apparatus for which the washing device of the present invention has been designed.

DETAILED DESCRIPTION OF PREFERRED EMBODIMENTS

Figure 1:
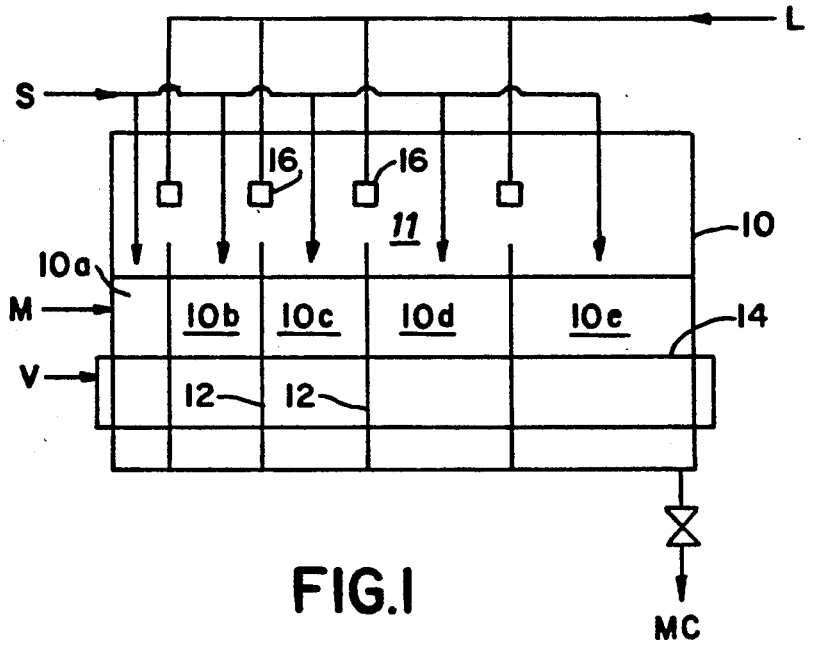

Referring now to the drawing and first to FIG. 1, there is shown a generally conventional apparatus for the continuous crystallization of sugar. This apparatus comprises closed, horizontally extending tank 10 having a wall defining interior chamber 11 for holding a liquid and partitions 12 dividing the interior chamber into adjacent compartments or cells 10*a*, 10*b*, 10*c*, 10*d*, 10*e*. The vertical partitions have a height lower than that of the tank side wall so that the compartments communicate with each other in the upper portion of interior tank chamber 11. In addition, compartments 10*a* to 10*e* communicate through openings in partitions 12 so as to permit circulation of a liquid to be subjected to crystallization from compartment 10*a* to compartment 10*e*. Radiator 14 in the lower portion of the interior tank chamber extends through the compartments and is fed by vapor V to heat the liquid flowing through the compartments. In the production of sugar crystals, first compartment 10*a* receives concentrated sugar syrup S and seed magma M containing crystallization seeds. The subsequent compartments receive metered amounts of syrup S. Massecuite MC is removed from last compartment 10*e*. The structure and operation of this apparatus is conventional.

In operation, partitions 12 have parts which are not immersed in the liquid flowing through compartments 10*a* to 10*e* and which are susceptible to becoming fouled by the crystals formed during the operation and which tend to become deposited on these partition parts. To clean these partition parts, the apparatus is equipped with a washing device comprising tubes passing through the wall of tank 10 and each tube having an end extending into interior chamber 10, tubing in communication with the tubes for feeding washing liquid L thereto, and nozzle 16 affixed to each tube, as shown in FIG. 1.

Figure 2:
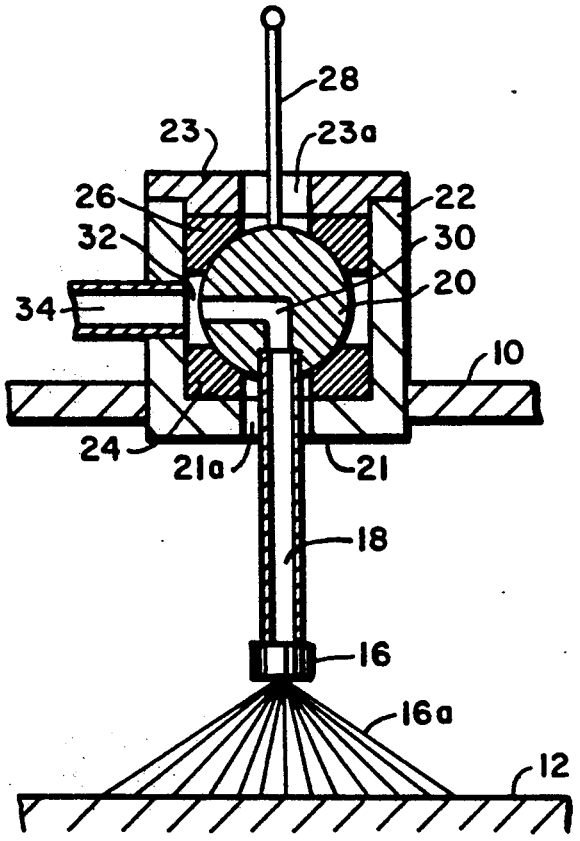
FIG. 2 is an enlarged sectional view showing one embodiment of one of the tubes and attached nozzles of the washing device.

In the embodiment of FIG. 2, nozzle 16 is shown to be arranged above a respective partition 12 to project the washing liquid in a flat jet onto the partition part susceptible to becoming fouled. Washing liquid L, which may be a solvent, such as water, or an undersaturated solution of the product to be crystallized, is fed to nozzles 16 through tube 18 by tubing 34 in communication with tube 18. For example, atomized water may be cyclically fed to nozzles 16 at a low flow rate. The plane of fan-shaped water spray 16*a* coincides with the plane of partition 12, and the number of nozzles positioned above each partition is selected according to the dimensions of the washing liquid jet and the partition so that the entire fouled surface of the upper partition part is washed.

As shown in FIG. 2, each nozzle 16 is affixed to an interior end of tube 18 whose opposite end is carried by body of revolution 20 which, in the illustrated embodiment is a spherical body. Body of revolution 20 is disposed in bearing box 22, which is mounted on the top wall of tank 10 in an aperture thereof and is shown welded to the side wall to provide a fluid-tight seal, and body 20 is pivotal in the bearing box. Bearing box 22 has bottom 21 defining opening 21*a* receiving tube 18 and being of a dimension which permits angular movements of tube 18 upon pivoting of body 20, and cover 23 closing the bearing box outside tank 10. Lever 28 is affixed to body 20 and passes through opening 23*a* in bearing box cover 23, opening 23*a* being of a dimension which permits angular movements of lever 2 for pivoting body 20 and tube 18 carried thereby.

As shown, two collars 24 and 26 are mounted in bearing box 22 and the collars bear body 20 therebetween, collar 24 being arranged adjacent bearing box bottom 21 and collar 26 being arranged adjacent bearing box cover 23. The collars define curved, i.e. spherical, bearing cavities complementary to the surface of body 20, thus constituting a ball-and-socket joint, and tube 18 and lever 28 pass through a respective one of collars 24, 26. As illustrated, the central passages through collars 24, 26 are aligned with openings 21*a* and 23*a* in the bottom and cover of the bearing box, the diameters of these openings being substantially larger than those of the tube and lever to permit angular movements thereof.

In the embodiment of FIG. 2, tubing 34 is connected laterally to bearing box 22 and opens into chamber 32 defined between the two collars 24, 26 in the bearing box around spherical body 20, and the body defines feeding channel 30 extending between tube 18 and bearing box chamber 32.

Bearing box 22 and collars 24, 26 may be of metal, rubber or synthetic resin. The collars are fluid-tightly mounted in the bearing box to avoid any escape of washing liquid, on the one hand, and entry of ambient air, on the other hand, when interior tank chamber 11 is under vacuum. If the collars are of rubber or a synthetic resin material of similar elasticity, a fluid-tight seal between the bearing box wall and the collars, on the one hand, and between the collars and body 20, on the other hand, will be assured, due to the pressure applied to the collars by cover 23. Optionally, collar 26 may be elastically pressed against body of revolution 20, for example by a resilient washer disposed between the collar and the bearing box cover. Also, if desired, a stop may be disposed in the pivoting path of lever 28 to hold the same in position against any vibrations or reactive forces to the washing liquid jet.

This mounting of nozzles 16 enables them to be repositioned from the outside of closed tank 10 by operating lever 28 so that tube 18 and nozzle 16 affixed thereto may be pivoted into a desired position with respect to associated partition 12, and this adjustment of the nozzles may be effected during operation of the apparatus.

The illustrated arrangement also enables the nozzles to be readily cleaned. If nozzle 16 becomes clogged, the operation of the apparatus is discontinued, cover 23, which may be screwed to bearing box 22, for example, is removed, and collar 26 as well as the assembly of spherical body 20, with attached lever 28 and tube 18, are taken out of the bearing box to clean nozzle 16. This cleaning operation requires only a short interruption of the operation of the apparatus. In contrast to this, in a conventional apparatus of this type, in which fixed washing liquid nozzles are affixed to the tank wall, cleaning of the nozzles is impractical because it would be necessary to cool the interior chamber for several hours after operation has been halted and the tank has been emptied before it would be possible to enter into the interior chamber for disassembling the nozzles and cleaning them.

Figure 3:
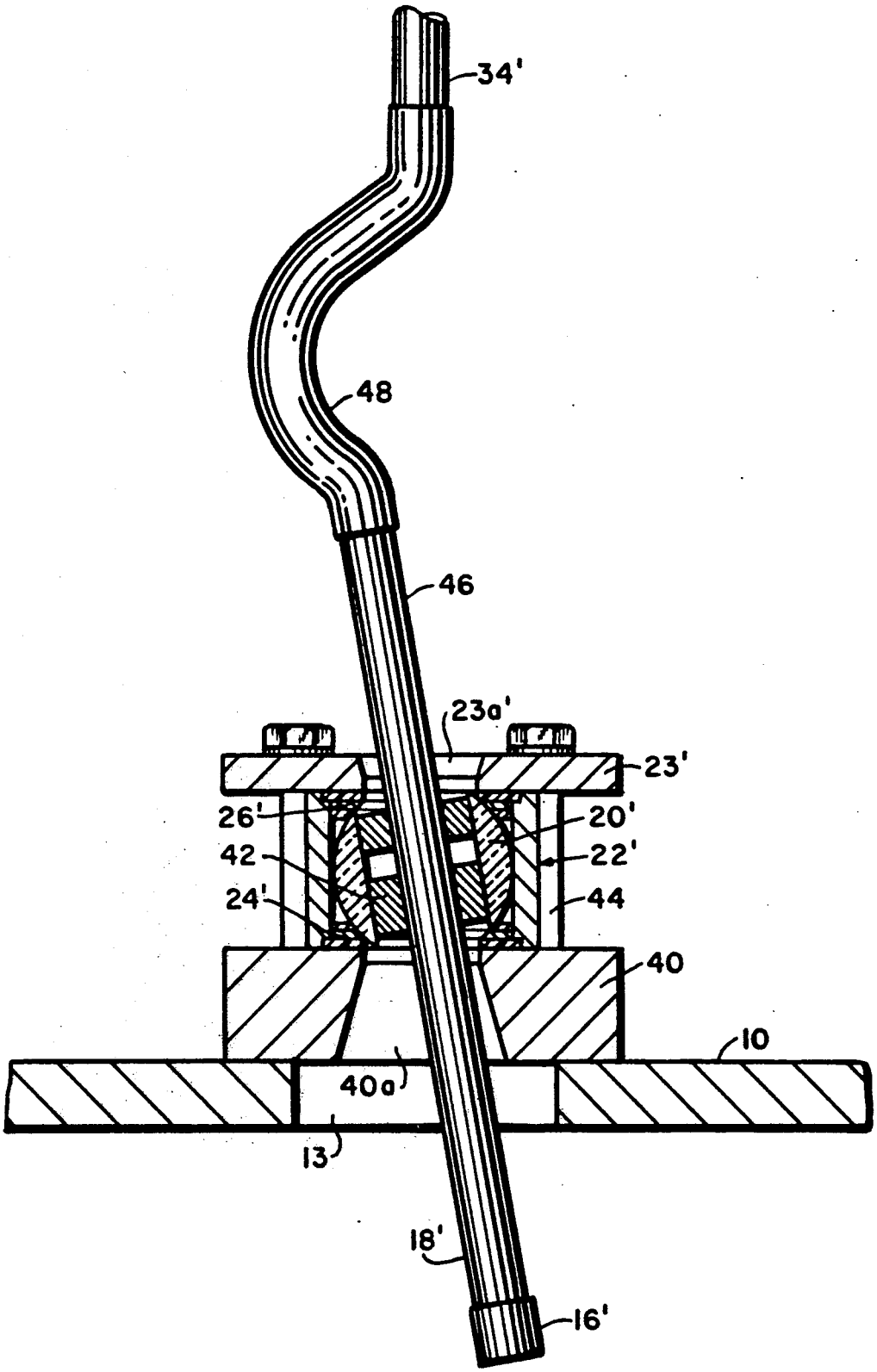
FIG. 3 is a like view of another embodiment.

FIG. 3 illustrates another embodiment of the mounting of nozzles 16. In this figure, like reference numerals designate like parts operating in a like manner. In this embodiment, bottom 40 of bearing box 22' for spherical body 20' is welded to the wall of tank 10 over opening 13 in the wall, which is aligned with opening 40*a* defined in bearing box bottom 40. Cover 23' for bearing box 22' is screwed to the bearing box bottom by bolts 44 for ready removal from the bearing box. Tube 18' is carried in spherical body 20' by bearing sleeves 42 extending through a diametrical bore in the spherical body, the tube being welded to the bearing sleeves and the bearing sleeves being welded to the spherical body. The interior end of tube 18' has nozzle 16 affixed thereto, and the spherical body is disposed between collars 24' and 26' in the bearing box. Tube 18' passes through collars 24', 26', body 20' and bearing box cover opening 23*a'*, and tube 18' includes outwardly projecting end portion 46 constituting the lever for pivoting spherical body 20' and tube 18' carried thereby. Hose 48 connects outwardly projecting tube end portion 46 to tubing 34' which feeds the washing liquid to nozzle 16.

Collars 24', 26' are constituted by stacks of elastic washers which form a fluid-tight seal with bearing box 22' and which are pressed in a fluid-tight manner against spherical body 20' when cover 23' is screwed to bottom 40 for closing bearing box 22'.

While this structure operates essentially in the same manner as that of FIG. 2 and has the same advantages, it is simpler. Pivoting outwardly projecting end portion 46 of tube 18' will re-orient nozzle 16 in the interior chamber of closed tank 10, and the nozzle may be removed for cleaning in the same manner as hereinabove described after cover 23' has been removed.

While a spherical body of revolution has been illustrated, this may be replaced by a cylindrical body carrying the nozzle tube. This cylindrical body is disposed in the bearing box with its axis substantially parallel to the upper edge of associated partition 12, and the curved cavities in the collars bearing the cylindrical body will be cylindrical to conform to the surface of the body.

What is claimed is:

1. A washing device for an apparatus comprising a tank having a wall defining an interior chamber for holding a liquid and substantially vertical partitions dividing the interior chamber, the partitions having parts which are not immersed in the liquid and are susceptible to becoming fouled, the washing device comprising (a) tubes passing through the wall of the tank and each of the tubes having an end extending into the interior chamber, (b) tubing in communication with the tubes for feeding a washing liquid thereto, (c) a nozzle affixed to each tube end and arranged to project the washing liquid onto respective ones of the partition parts susceptible to becoming fouled, (d) a spherical body of revolution carrying each tube, (e) a bearing box holding each spherical body inside thereof, the bearing box being mounted fluid-tight on the wall of the tank and the body being pivotal in the bearing box about a substantially horizontal axis, the bearing box having (1) a bottom defining an opening receiving the tube and being of a dimension which permits angular movements of the tube upon pivoting of the body, and (2) a cover closing the bearing box outside the tank, and (3) two collars mounted in the bearing box and bearing the spherical body therebetween, one of the collars being arranged adjacent the bearing box bottom and one of the collars being arranged adjacent the bearing box cover, the collars defining curved bearing cavities complementary to the surface of the body, and the tube and lever passing through a respective one of the collars, and (f) a lever affixed to the body and passing through an opening in the bearing box cover, the opening being of a dimension which permits angular movements of the lever for pivoting the body and the tube carried thereby about said horizontal axis.

2. The washing device of claim 1, wherein the tube passes through the collars, the body and the bearing box cover opening, the tube including an outwardly projecting end portion constituting the lever, and further comprising a hose connecting the outwardly projecting tube end portion to the tubing.

* * * * *